US005483246A

United States Patent [19]

Barnett et al.

[11] Patent Number: 5,483,246

[45] Date of Patent: Jan. 9, 1996

[54] OMNIDIRECTIONAL EDGE FED TRANSMISSION LINE ANTENNA

[75] Inventors: Kenneth C. Barnett, Delray Beach; Lorenzo A. Ponce De Leon, Lake Worth; Charles R. McMurray, Boynton Beach; Nadim M. Halabi, Sunrise, all of Fla.

[73] Assignee: Motorola, Inc., Schaumburg, Ill.

[21] Appl. No.: 317,057

[22] Filed: Oct. 3, 1994

[51] Int. Cl.[6] ..... H01Q 1/36

[52] U.S. Cl. ..... 343/700 MS; 343/702; 343/845; 343/846

[58] Field of Search ..... 343/700 MS, 702, 343/749, 829, 830, 845, 846, 847, 848; 455/380.1, 280; 340/825.44; H01Q 1/36, 1/38, 5/00

[56] References Cited

U.S. PATENT DOCUMENTS

| | | | |
|---|---|---|---|
| 4,700,194 | 10/1987 | Ogawa et al. | 343/700 MS |
| 4,749,996 | 6/1988 | Tresselt | 343/829 X |
| 4,924,237 | 5/1990 | Honda et al. | 343/848 X |
| 4,935,745 | 6/1990 | Mori et al. | 343/702 |
| 4,940,992 | 7/1990 | Nguyen et al. | 343/702 |
| 5,220,335 | 6/1993 | Huang | 343/700 MS |
| 5,278,546 | 1/1994 | Weitzen et al. | 340/825.44 |

FOREIGN PATENT DOCUMENTS

| | | | |
|---|---|---|---|
| 0168102 | 7/1989 | Japan | H01Q 5/00 |

*Primary Examiner*—Donald T. Hajec
*Assistant Examiner*—Tho Phan
*Attorney, Agent, or Firm*—Philip P. Macnak; Daniel K. Nichols; John H. Moore

[57] ABSTRACT

An omnidirectional antenna (100) includes a resonator (102) and a ground plane (104). The resonator (102) includes a dielectric substrate (402) having a top conductive plate (404) and a bottom conductive plate (406), wherein the top conductive plate (404) is shorted to the bottom conductive plate (406) proximal to a first end (436) and open at a second end (438) of the dielectric substrate (402), a resonator feed (416) having a location between the first (436) and second (438) ends, a first resonator ground (424) and a second resonator ground (408) coupled between the bottom conductive plate (406) and the ground plane (104), the first resonator ground (424) being contiguous to the bottom conductive plate (406) and having a location which is distal to the first end (436) for suppressing undesirable resonator resonance, and the second resonator ground (408) being contiguous to the bottom conductive plate (406) and having a location which is proximal to the first end (436) for controlling a radiation pattern of the resonator (102) to produce a substantially omnidirectional antenna beam pattern.

28 Claims, 4 Drawing Sheets

100

SECTION "A-A"

OMNIDIRECTIONAL EDGE FED TRANSMISSION LINE ANTENNA

BACKGROUND OF THE INVENTION

In accordance with one aspect of the present invention, an omnidirectional antenna comprises a conductiver plate and a resonator. The resonator is positioned adjacent to the conductive plate and comprises a dielectric substrate having a top conductive plate and a bottom conductive plate, wherein the bottom conductive plate provides a ground plane for the resonator and wherein the top conductive plate is shorted to the bottom conductive plate at a first end of the dielectric substrate and open at a second end of the dielectric substrate, a resonator feed located between the first and second ends of the dielectric substrate, a first resonator ground connected to the bottom conductive plate and having a location which is distal to the first end of the dielectric substrate, and a second resonator ground connected to the top conductive plate and to the bottom conductive plate and having a location which is proximal to the first end of the dielectric substrate, wherein the first resonator ground is connected to the conductive plate for suppressing undesirable resonator resonance, and the second resonator ground is connected to the conductive plate for controlling a radiation pattern of the resonator to produce a substantially omnidirectional antenna beam pattern.

In accordance with another aspect of the present invention, an omnidirectional antenna for a receiving device comprises a substrate having a first metallization layer which connects components for a receiver, and at least a second metallization layer which establishes a receiver ground plane, and a resonator. The resonator is positioned adjacent to the substrate and comprises a dielectric substrate having a top conductive plate and a bottom conductive plate, wherein the bottom conductive plate provides a ground plane for the resonator and wherein the top conductive plate is shorted to the bottom conductive plate at a first end of the dielectric substrate and open at a second end of the dielectric substrate. A resonator feed is coupled to the receiver and has a location between the first and second ends of the dielectric substrate and provides an intercepted signal to the receiver. A first resonator ground is connected to the bottom conductive plate and has a location which is distal to the first end of the dielectric substrate, and a second resonator ground is connected to the top conductive plate and to the bottom conductive plate and has a location which is proximal to the first end of the dielectric substrate, wherein the first resonator ground is connected to the receiver ground plane and suppresses undesirable resonator resonance, and the second resonator ground is connected to the receiver ground plane and controls a radiation pattern of the resonator to produce a substantially omnidirectional antenna beam pattern.

In accordance with another aspect of the present invention, a portable communication device comprises an omnidirectional antenna, a receiver, a decoder and an alerting device. The omnidirectional antenna comprises a substrate which has a first metallization layer, and at least a second metallization layer which establishes a receiver ground plane and a resonator. The resonator is positioned adjacent to the substrate and comprises a dielectric substrate which has a top conductive plate and a bottom conductive plate, wherein the bottom conductive plate provides a ground plane for the resonator and wherein the top conductive plate is shorted to the bottom conductive plate at a first end of the dielectric substrate and open at a second end of the dielectric substrate. A resonator feed is location between the first and second ends of the dielectric substrate and provides an intercepted message signal including an address. A first resonator ground is connected to the bottom conductive plate has a location distal to the first end of the dielectric substrate, and a second resonator ground is connected to the top conductive plate and to the bottom conductive plate and has a location proximal to the first end of the dielectric substrate, wherein the first resonator ground is connected to the receiver ground plane for suppressing undesirable resonator resonance, and the second resonator ground is connected to the receiver ground plane for controlling a radiation pattern of the resonator to produce a substantially omnidirectional antenna beam pattern. The receiver is interconnected by the first metallization layer and coupled to the resonator feed and receives and demodulates the intercepted message signal including the address by the omnidirectional antenna. The decoder is interconnected by the first metallization layer and is coupled to receiver and decodes the address received, and generates an alert control signal in response to the address matching a predetermined address. The alerting device is interconnected by the first metallization layer and is responsive to the alert control signal for alerting a user of a message.

In accordance with yet another aspect of the present invention, a transmitting device comprises a radio wave transmitter for transmitting communication signals and an omnidirectional antenna which is coupled to the radio wave transmitter and launches the communication signals for transmission. The omnidirectional antenna comprises a conductive plate, and a resonator. The resonator is positioned adjacent to the conductive plate and comprises a dielectric substrate which has a top conductive plate and a bottom conductive plate, wherein the bottom conductive plate provides a ground plane for the resonator and wherein the top conductive plate is shorted to the bottom conductive plate at a first end of the dielectric substrate and open at a second end of the dielectric substrate. A resonator feed is located between the first and second ends of the dielectric substrate and is coupled to the radio wave transmitter and receives the communication signals to be launched. A first resonator ground is connected to the bottom conductive plate and positioned distal to the first end of the dielectric substrate, and a second resonator ground is connected to the top conductive plate and to the bottom conductive plate and is positioned proximal to the first end of the dielectric substrate, wherein the first resonator ground is connected to the conductive plate and suppresses undesirable resonator resonance, and the second resonator ground is connected to the conductive plate and controls a radiation pattern of the omnidirectional antenna to launch a substantially omnidirectional antenna beam.

DESCRIPTION OF THE PREFERRED EMBODIMENTS

Figure 1:
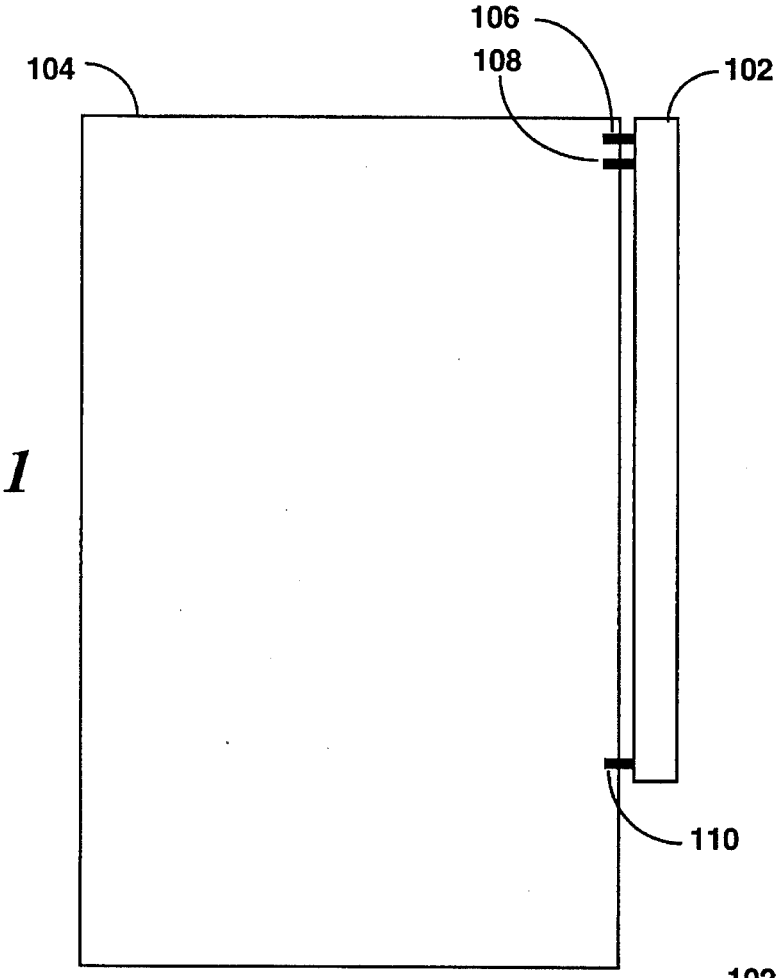
FIG. 1 is a top orthogonal view of an omnidirectional edge fed transmission line antenna in accordance with the preferred embodiment of the present invention.

FIG. 1 is a top orthogonal view of an omnidirectional edge fed transmission line antenna 100 in accordance with the preferred embodiment of the present invention. The omnidirectional edge fed transmission line antenna 100 comprises a resonator 102 and a substrate 104 which includes a ground plane, or radio mass, as will be described further below. The resonator 102 is a low loss resonant structure which supports it own resonance and which is coupled to the ground plane of substrate 104 as will be described below in such a manner that the resonator 102 retains its electrical performance while utilizing the ground plane of the radio to extract energy from an incident electromagnetic wave without regard to specific polarization in such a manner that a near omnidirectional antenna pattern is realized as will be described below. By utilizing the ground plane to extract energy, the omnidirectional edge fed transmission line antenna 100 takes full advantage of the package size within which the antenna is utilized, unlike prior loop and slot antenna systems.

The connection to the ground plane of substrate 104, hereinafter referred to as ground plane, or plate, 104, requires at least two connections 106, 110 between the resonator 102 and the ground plane 104, and an additional resonator feed connection 108 as shown in FIG. 1. The first resonator to ground plane connection 110 allows for the suppression of undesirable resonator 102 resonance's which result in a reduction of antenna efficiency. The exact location of connection 110 can be determined empirically through the use of antenna efficiency measurements. The second resonator to ground plane connection 106 allows for control of the radiation pattern which produces a near omnidirectional beam in both the E- and H-planes. The exact location of connection 106 can also be determined empirically through the use of antenna efficiency measurements.

As described above, when the second resonator to ground plane connection is properly adjusted, the omnidirectional edge fed transmission line antenna 100 provides polarization diversity, such that in a scattering or Rayleigh fading environment, the omnidirectional edge antenna is responsive to intercept the strongest vertically or horizontally polarized signal which is present at any given point within a communication system. As a consequence, the omnidirectional edge fed transmission line antenna 100, is able to maintain high antenna sensitivity in varied device orientations, both "on the body" and "off the body".

Figure 2:
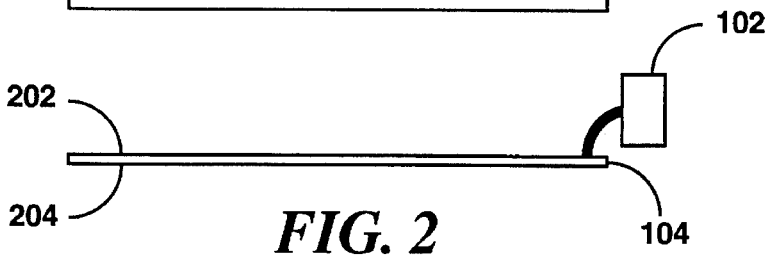
FIG. 2 is a side view of the omnidirectional edge fed transmission line antenna in accordance with the preferred embodiment of the present invention.

FIG. 2 is a side view of the omnidirectional edge fed transmission line antenna 100 in accordance with the preferred embodiment of the present invention. As shown, the resonator 102 is located adjacent to the substrate 104 which comprises a first metallization layer 202 which can be utilized to interconnect the components of the receiver, and at least a second metallization layer 204 which can provide the ground plane for the receiver. It will be appreciated that the functions of the first metallization layer 202 and the second metallization layer 204 can be reversed, and in fact can be intermixed as will be described in further detail below. For purposes of clarity throughout the rest of the specification, while reference number 104 refers to the substrate 104, the reference number will also be applied to the metallization 202 or 204 which is acting as the ground plane, or ground plane 104.

Figure 3:
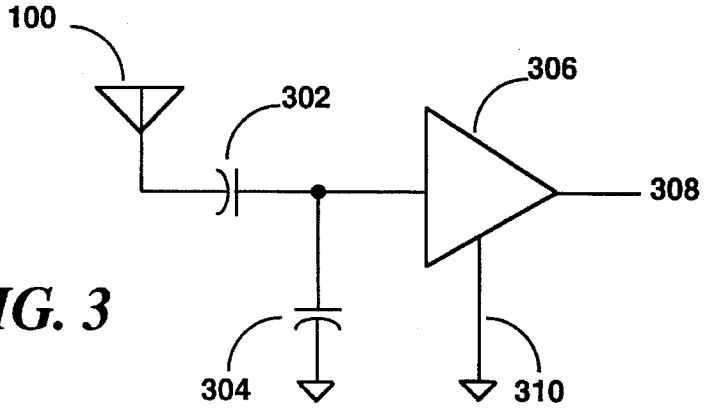
FIG. 3 is an electrical block diagram of the omnidirectional edge fed transmission line antenna in accordance with the preferred embodiment of the present invention coupled to a receiver.

FIG. 3 is an electrical block diagram of the omnidirectional edge fed transmission line antenna 100 in accordance with the preferred embodiment of the present invention coupled to a receiver. The omnidirectional edge fed transmission line antenna 100 is coupled in a conventional manner to the input of an RF amplifier 306 generally through a coupling capacitor 302. A second capacitor 304 may also be coupled between the RF amplifier 306 input and to the receiver ground which is also the ground plane of the omnidirectional edge fed transmission line antenna 100. The RF amplifier 306 is also coupled to the ground plane through a ground connection 310. Transmitted signals intercepted by the omnidirectional edge fed transmission line antenna 100 are amplified by the RF amplifier 306 in a manner well known to one of ordinary skill in the art. The amplified signals are then presented at the RF amplifier output 308 for processing by other receiver circuits.

Figures 4, 5, 6:
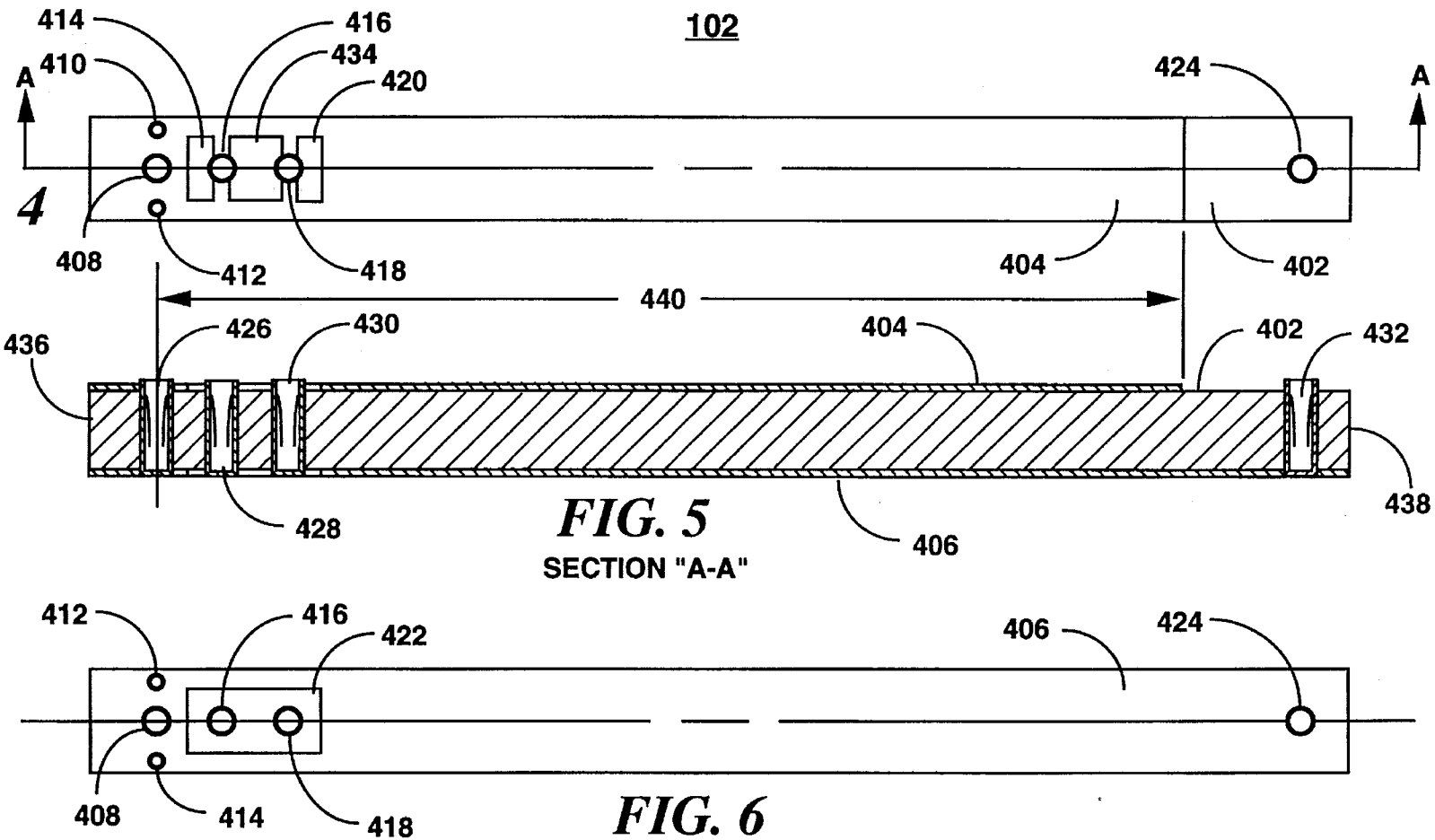
FIG. 4 is a top orthogonal view of a resonator utilized in the omnidirectional edge fed transmission line antenna of FIG. 1.
FIG. 5 is a cross sectional view of the resonator utilized in the omnidirectional edge fed transmission line antenna of FIG. 1.
FIG. 6 is a bottom orthogonal view of the resonator utilized in the omnidirectional edge fed transmission line antenna of FIG. 1.

FIG. 4 is a top orthogonal view of a resonator 102 utilized in the omnidirectional edge fed transmission line antenna of FIG. 1. The resonator 102 comprises a dielectric substrate 402 which has a top conductive plate 404 and a bottom conductive plate 406 shown in FIG. 5. The top conductive plate 404 is shorted to the bottom conductive plate 406 at a first end 436 of the dielectric substrate 402, specifically by two plated through holes 410 and 4,12 and by the second resonator ground interconnect 408, and open at a second end 438 of the dielectric substrate 402. The position of the second resonator ground interconnect 408 relative to the ground plane 104 (referenced to the first end 436 of the dielectric substrate 402) controls the radiation pattern which when properly selected produces a near omnidirectional beam in both the E- and H-planes, as was described above. A resonator feed 416 is located between the first 436 and second 438 ends of the dielectric substrate 402, specifically at the resonator feed 416 location as shown. The position of the resonator feed 416 relative to the first end 436 of the dielectric substrate 402 determines the impedance of the resonator. As shown in FIG. 4, several resonator feed points can be provided for the resonator 102, such as resonator feeds 416 and 418. In the preferred embodiment of the present invention resonator feed 416 provides a 50 ohm impedance, as will be described further below, whereas resonator feed 418 provides a higher impedance. The resonator feeds 416 and 418 are surrounded by areas 414, 434 and 420 where the top conductive plate 404 is removed.

A first resonator ground 424 is provided through a socket 432 (shown in FIG. 5), and a second resonator ground 408 is also provided through a socket 426 are coupled between the bottom conductive plate 406 and the ground plane as shown in FIG. 1. The first resonator ground 424 is contiguous to the bottom conductive plate 406 and has a location which is distal to the first end 436 of the dielectric substrate 402, and as described above suppresses undesirable resonator resonance. The second resonator ground 408 is contiguous to the bottom conductive plate 406 and has a location which is proximal to the first end 436 of the dielectric substrate 402, and as described above controls the radiation pattern of the resonator to produce a substantially omnidirectional antenna beam pattern.

FIG. 5 is a cross sectional view of the resonator utilized in the omnidirectional edge fed transmission line antenna 100 of FIG. 1. The resonator 102 is formed from a dielectric substrate 402, a top conductive plate 404 and a bottom conductive plate 406. Sockets 426 and 432 provide connection between the resonator 102 and the ground plane 104, as described above. Sockets 428 and 430 provide selective connection to the RF amplifier input, also as described above.

The dielectric substrate 402 is preferably a material which provides a mid-range dielectric constant and a low loss tangent, such as a TMM-3 temperature stable microwave material manufactured by Rogers Corporation of Chandler, Ariz. The use of a mid-range dielectric material reduces the overall resonator size which is critical for the newer generations of small portable communication devices, while the low loss tangent improves the efficiency of the resonator 102 coupling to the ground plane. The TMM-3 temperature stable microwave material has the following electrical characteristics shown in Table I.

TABLE I

| Parameter | Value |
|---|---|
| Dielectric Constant | 3.27 ± 0.016 |
| Loss tangent | 0.0016 |
| Thermal Coefficient | +39 ppm/°C. |

The top 404 and bottom 406 conductive plates are formed from 1 ounce copper plated to the upper and lower surfaces of the dielectric substrate 402, although it will be appreciated that other thicknesses of copper plating can be utilized as well. A dry film solder mask (not shown) is used to protect the copper plate from environmental factors, such as humidity and corrosive contaminants. By way of example, a resonator 102 having a resonant frequency of 930.5 MHz and constructed using a 0.125 inch (3.18 mm) thick TMM-3 dielectric material would have a width of 0.200 inch (5.08 mm) and a dielectric and bottom plate length of 2.305 inches (58.55 mm) with a top plate length 440 (measured to the resonator ground connection 408) of 1.870 inches (47.50 mm) which corresponds to effectively one-quarter wavelength at 930.5 MHz. Such a resonator, when coupled to the RF amplifier of circuit of FIG. 3, would provide a 50 ohm input from resonator feed 416 and would have a bandwidth of between 7–8 MHz measured using a 10 dB return loss criterium. It will be appreciated that such a resonator when utilized for the 929–932 MHz paging communication band would not require any tuning to match to the RF amplifier. It should be noted that since the resonator feeds 416 or 418 are coupled to the top conductive plate 404, which in turn are coupled to the bottom conductive plate 406 through the plated through holes 410, 412 and the resonator ground 408, the resonator 102 effectively provides a short circuit to the resonator feed input, thereby protecting the RF amplifier input from such damaging effects as static electricity. Also, since there are no capacitors on the antenna structure, hi-voltage capacitors are not required in transmitter applications, as will be described below.

It will be appreciated that the effective resonator wavelength is a function of the dielectric material utilized, and the resonator size can be manufactured to any resonator wavelength which a multiple of a quarter wavelength where size is not a constraint. It will be further appreciated, that when the resonator wavelength is set to odd multiple quarter wavelengths, the physical arrangement of the resonator elements is as described above, whereas when the resonator wavelength is set even multiple quarter wavelengths, the top conductive plate 404 and the bottom conductive plate 406 would also be shorted at the second end 438 of the dielectric substrate 402.

As described above, in the preferred embodiment of the present invention, sockets 426, 428, 430 and 432 are utilized to provide interconnection between the resonator 102 and the ground plane 104. Sockets suitable for such use are manufactured by Autosplice® of San Diego, Calif., their part no. 26-190M16GL. A suitable pin, also manufactured by Autosplice® is their part no. 8-255C3931. It will be appreciated that other sockets and pins can be used. It will also be appreciated that the sockets and pins can also be eliminated when there is no reason to separate the resonator 102 from the ground plane 104 after assembly. When the sockets are eliminated the holes are plated through to provide electrical contact and to facilitate soldering for interconnection.

FIG. 6 is a bottom orthogonal view of the resonator utilized in the omnidirectional edge fed transmission line antenna of FIG. 1. The bottom conductive plate 406 couples to the plated through holes 412 and 414 and the ground connections 408 and 424. The resonator feeds 416 and 418 are isolated from the bottom conductive plate 406 by an area 422 devoid of plating.

Figure 7:
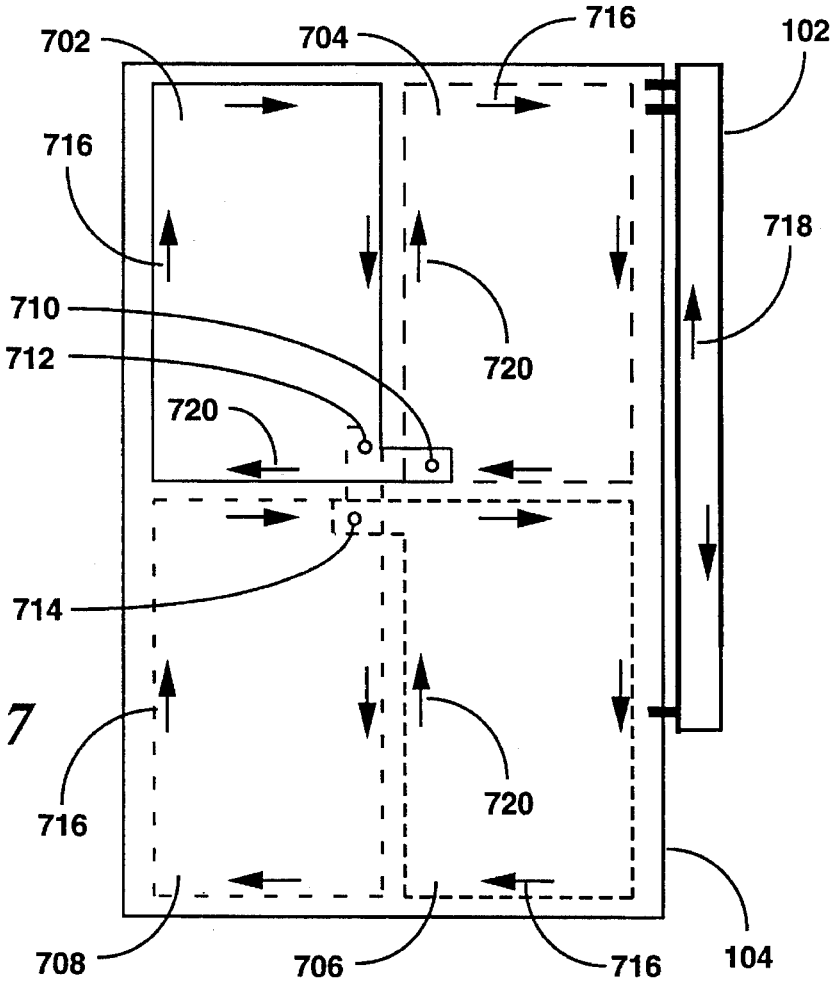
FIG. 7 is a top orthogonal view of the omnidirectional edge fed transmission line antenna in accordance with an aspect of the present invention.

FIG. 7 is a top orthogonal view of the omnidirectional edge fed transmission line antenna in accordance with an aspect of the present invention. As was previously described briefly in FIG. 2, the substrate 104 provides a first metallization for connecting the components of the receiver, and at least a second metallization pattern which provides a ground plane. In FIG. 7, the substrate 104 is shown as being a multi-layer circuit board, such as constructed using a G-10 or FR-4™ glass epoxy circuit board material. As also shown in FIG. 7, the ground plane need not be constrained to a single metallization layer, but may in fact be provided by metallization 702 in a first layer, metallization 704 in a second layer, metallization 706 in a third layer and metallization 708 in a fourth layer. Each of the metallization layers 702, 704, 706 and 708 are interconnected, such as by plated through holes 710, 712 and 714, thereby providing a ground plate surface area almost as large as the substrate 104. When an electromagnetic wave is incident upon the omnidirectional edge fed transmission line antenna 100, circulating currents 716, 720 are set up in the ground plates defined by the metallization layers 702, 704, 706 and 708. Those circulating currents 720 which are internal the ground plane edges substantially cancel each other leaving a relatively high level peripheral circulating current 716. The peripheral circulating current 716 is generated when energy is scattered from the ground plane which occurs when $$[\text{plate area/wavelength}]^2 >= 1$$

where plate area refers to the area of the ground plane or scattering surface and wavelength is the wavelength of the incident EM wave to which the resonator 102 is tuned. The peripheral circulating current 716 electromagnetically induces a circulating current 718 within the lower conductive plate 406 of resonator 102 which is then coupled, as by example, through the resonator feed 416 to the input of the RF amplifier. Since the ground plane 104 has no intrinsic polarization, it will be appreciated that the ground plane 104 acts as an efficient antenna in whatever orientation it is placed. By properly positioning the second resonator to ground plane connection 106, as described in FIG. 1, the radiation pattern of the omnidirectional edge fed transmission line antenna 100 produces a near omnidirectional beam for both the E- and H-planes of an incident electromagnetic wave.

Figure 8:
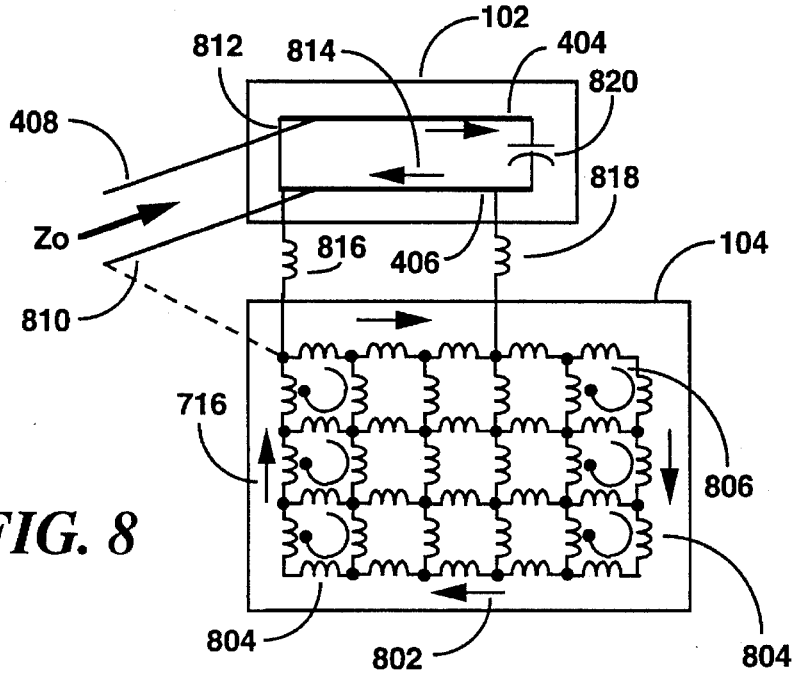
FIG. 8 is an electrical block diagram of the omnidirectional edge fed transmission line antenna in accordance with the preferred embodiment of the present invention.

FIG. 8 is an electrical block diagram of the omnidirectional edge fed transmission line antenna 100 in accordance with the preferred embodiment of the present invention. Shown schematically in FIG. 8 is the resonator 102 which comprises an upper conductive plate 404, a lower conductive plate, or ground plate, 406, the short circuit element 812, at the first, or proximal, end of the dielectric substrate, and the open circuit, represented by a capacitor 820, at the second, or distal, end of the dielectric substrate. The ground plane 104 is represented as a plurality of interconnected mesh inductance's 804 within which mesh currents 806 circulate when the ground plane 104 is excited by an incident electromagnetic wave. As described above, the internal mesh currents substantially cancel each other, which results in the generation of the peripheral circulating current 716. The resonator feed 408 couples to the top conductive plate 404 of the resonator 102, while a circuit ground 810 is coupled to the bottom conductive plate 406 of the resonator 102. In practice, the circuit ground 810 also couples to the ground plane 804, as indicated by the dashed line. The first resonator to ground plane connection 110 is represented by an inductor 818, while the second resonator to ground plane connection 106 is represented by an inductor 816.

Figure 11:
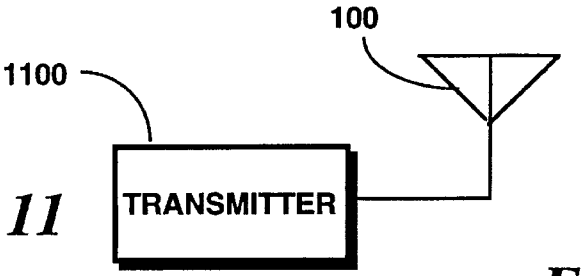
FIG. 11 is an electrical block diagram of a transmitter which utilizes the omnidirectional edge fed transmission line antenna in accordance with the preferred embodiment of the present invention.

In operation, the omnidirectional edge fed transmission line antenna 100 is produced using co-located transmission lines, one created via the resonator 102 and another created between the resonator ground plate 406 and the ground plane 104. The two transmission line structures are connected to achieve maximum coupling between the peripheral circulating currents 716 on the ground plane 104 and those on the resonator 102 in order to achieve a near omnidirectional antenna pattern while maintaining high efficiency. The resonator 102 is a narrow width resonating structure, which in a transmission mode such as shown in FIG. 11 is also an efficient radiator at the transmitter operating frequency. The radiator efficiency is accomplished by using a low loss dielectric with a conductor on the top 404 and bottom 406 surfaces of the dielectric substrate 402. The overall dimensions of the resonator 102 are such that the resonator substrate 402 is slightly greater than a quarter wavelength in the substrate media. The resonator 102 is "tuned" by adjusting the length of the top conductive plate 404. The current distribution on the resonator is such that without further modifications, the pattern of the resonator 102 alone has a strong E-plane response and is non-responsive to the H-plane polarization. The omnidirectional edge fed transmission line antenna 100 achieves both omnidirectionality and high efficiency by adjusting the location and orientation of the resonator 102 with respect to the ground plane 104. The ground plane 104 can be a unique plate, such as defined as a metallization layer of a printed circuit board, or can in practice be the actual receiver ground plane. As described above, the ground plane becomes activated when placed in an electromagnetic field. The incident electromagnetic wave induces a peripheral circulating current 716 on the ground plane 104 which now acts as part of the antenna. In the preferred embodiment of the present invention, the resonator 102 is located at the edge of the ground plane 104 and is fed from the corner as shown in FIG. 1. The position of the resonator feed 416 is adjusted relative to the top conductive plate 404 in order to vary the driving point impedance. The asymmetrical positioning (adjacent to the ground plane 104) and feeding of the resonator 102 allows the resonator 102 to take advantage of the peripheral circulating current 716 which is generated on the ground plane 104. As a result, the resonator 102 works in conjunction with the ground plane 104. Thus the entire structure becomes the antenna which comprises a driven element, the resonator 102, and a parasitic element, the ground plane 104. The superposition of peripheral circulating currents 716 that flow on the ground plane 104 with the circulating currents 814 which flow on the resonator 102, and which are efficiently coupled, enables the realization of a near omnidirectional antenna pattern which results in improved antenna efficiency.

The coupling mechanism between the resonator 102 and the ground plane 104 is created by the corner-edge feed structure and the modes propagating between the two ground planes 104 and 406. Since the resonator has an independent ground plane 406, the resonator 102 resonance is relatively independent of the location near a neighboring ground plane, which allows optimum placement of the driven element, the resonator 102, with respect to the ground plane 104 without the need for close control of any resonant characteristics of the ground plane 104. This allows the driven element, the resonator 102, to be positioned to take maximum advantage of the resulting peripheral circulating currents 716 which are developed on the ground plane 104.

Figure 9:
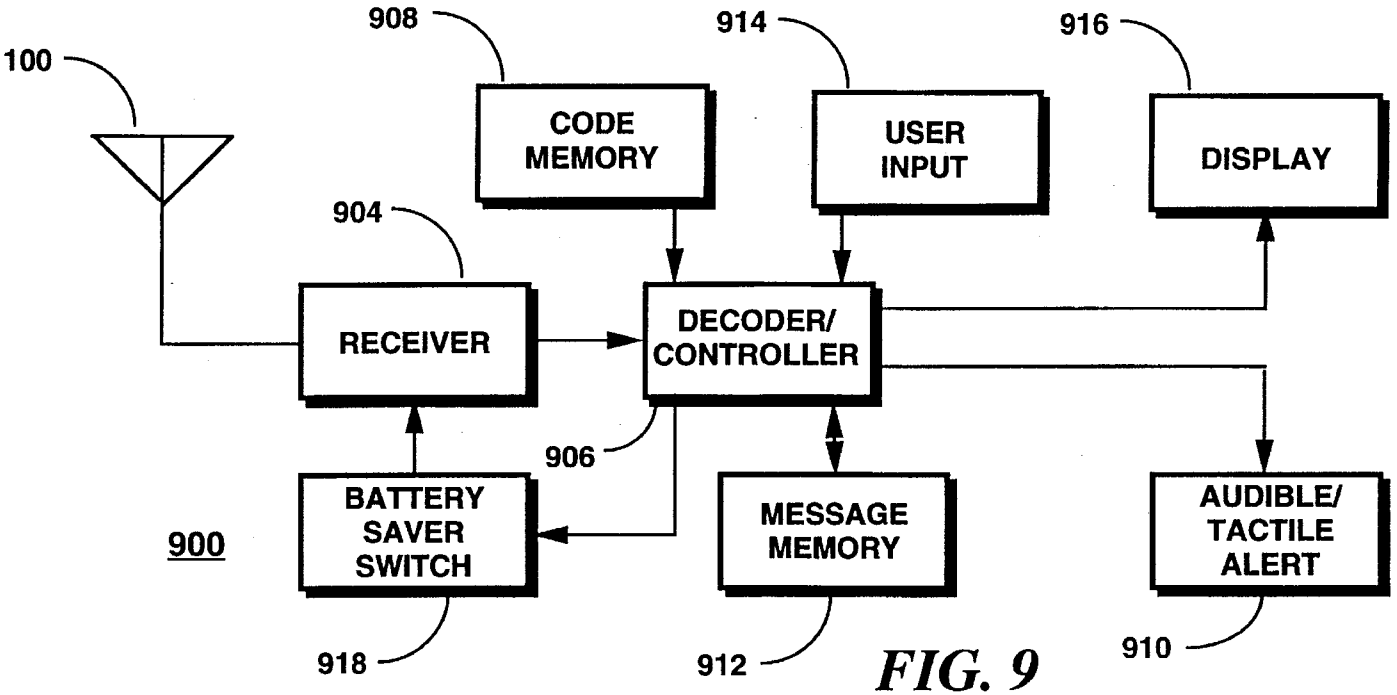
FIG. 9 is an electrical block diagram of a portable communication device which utilizes the omnidirectional edge fed transmission line antenna in accordance with the preferred embodiment of the present invention.

FIG. 9 is an electrical block diagram of a portable communication device which utilizes the omnidirectional edge fed transmission line antenna 100 in accordance with the preferred embodiment of the present invention. The omnidirectional edge fed transmission line antenna 100 is coupled, as described above, to the input of a receiver 904 which receives and processes, in a manner well known to one of ordinary skill in the art, the intercepted signals transmitted at the operating frequency of the receiver 904. In practice, the intercepted signals include address signals identifying the portable communication device to which message signals are intended. The received address signals are coupled to the input of a decoder/controller 906 which compares the received address signals with a predetermined address which is stored within the code memory 908. When the received address signals match the predetermined address stored, the message signals are received, and the message is stored in a message memory 912. The decoder/controller also generates an alert enable signal which is coupled to an audible/tactile alerting device to generate and audible or a tactile alert indicating that a message has been received. The audible/tactile alert can be reset by the portable communication device user, and the message can be recalled from the message memory 912 via controls 914 which provide a variety of user input functions. The message recalled from the message memory 912 is directed via the decoder/controller 906 to a display, such as an LCD display, where the message is displayed for review by the portable communication device user. While the description of the portable communication device provided above described a selective call receiving device, it will be appreciated that any radio wave receiving device can benefit from the use of the omnidirectional edge fed transmission line antenna 100.

Figure 10:
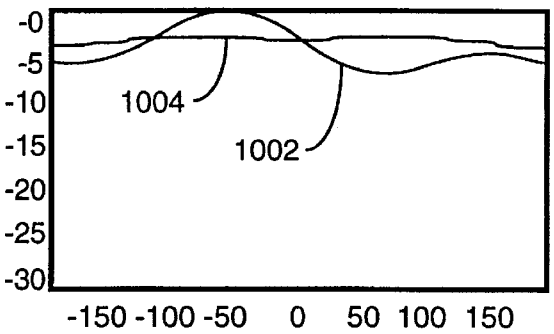
FIG. 10 is a graph depicting the antenna performance of the omnidirectional edge fed transmission line antenna in accordance with the preferred embodiment of the present invention.

FIG. 10 is a graph depicting the antenna performance of the omnidirectional edge fed transmission line antenna 100 in accordance with the preferred embodiment of the present invention. The graph shows both the omnidirectional edge fed transmission line antenna 100 response to both the E-plane 1002 and the H-plane 1004 of the incident electromagnetic wave. As an E-plane antenna, the received signal varies approximately 5 dB as the antenna orientation is varied over a 360 degree pattern. An H-plane antenna the received signal varies approximately 1–2 dB as the antenna orientation is varied over a 360 degree pattern. When both the E-plane and H-plane responses are superimposed, it will be appreciated that the antenna provides a high efficiency and in essentially omnidirectional.

FIG. 11 is an electrical block diagram of a transmitter utilizing the omnidirectional edge fed transmission line antenna 100 in accordance with the preferred embodiment of the present invention. The transmitter 1100 comprises a radio wave transmitter 1102 which modulates a communication signal onto a radio frequency carrier, and which further amplifies the communication signal for transmission in a manner well known to one of ordinary skill in the art. The omnidirectional antenna 100 is coupled to the radio wave transmitter 1102 and launches the communication signals received from the transmitter for transmission. The operation of the omnidirectional antenna when used as a transmitting antenna is similar to that described above as a receiving antenna, except that the transmitter output couples to the resonator feed 416. The substrate 104 can include a ground plane as described above, or may be a conductive plate, such as formed from a copper sheet. The copper sheet is plated to protect the copper from environmental factors, such as humidity and corrosive contaminants, although it will be appreciated that other methods of environmental protection, such as provided by a dry film solder mask can be utilized as well. As was described above, the first resonator ground is contiguous to the bottom conductive plate and is positioned distal to the first end of the dielectric substrate for suppressing undesirable resonator resonance which would reduce the antenna output, and the second resonator ground is contiguous to the bottom conductive plate and is positioned proximal to the first end of the dielectric substrate for controlling the radiation pattern of the omnidirectional antenna to launch a substantially omnidirectional antenna beam.

In summary, an omnidirectional edge fed transmission line antenna 100 has been described above which provides an improved antenna sensitivity as the size of the antenna is reduced as compared to a conventional loop or slot antenna. The omnidirectional edge fed transmission line antenna 100 described above provides a near omnidirectional antenna pattern, allowing the personal portable communication device to be utilized both "on the body" and "off the body". The omnidirectional edge fed transmission line antenna 100 described above maintains a high antenna sensitivity in an increasingly varied number of device orientations, both "on the body" and "off the body". And the omnidirectional edge fed transmission line antenna 100 described above, takes full advantage of the package size within which the antenna is to be utilized.

We claim:

1. An omnidirectional antenna, comprising:

a ground plane; and a resonator, comprising a dielectric substrate having a top conductive plate and a bottom conductive plate, wherein said top conductive plate is shorted to said bottom conductive plate at a first end of said dielectric substrate and open at a second end of said dielectric substrate, a resonator feed, having a location between said first and second ends of said dielectric substrate, a first resonator ground being connected to said bottom conductive plate and having a location which is distal to said first end of said dielectric substrate, and a second resonator ground being connected to said top conductive plate and to said bottom conductive plate and having a location which is proximal to said first end of said dielectric substrate, wherein said first resonator ground being connected to said ground plane for suppressing undesirable resonator resonance, and said second resonator ground being connected to said ground plane for controlling a radiation pattern of said resonator to produce a substantially omnidirectional antenna beam pattern.

2. The omnidirectional antenna according to claim 1 wherein said top conductive plate and said bottom conductive plate have a predetermined length and width, and wherein said length is substantially greater than said width.

3. The omnidirectional antenna according to claim 2 wherein the omnidirectional antenna has a predetermined operating frequency, and wherein said predetermined length of said top conductive plate is equal to or greater than one-quarter wavelength at the predetermined operating frequency.

4. The omnidirectional antenna according to claim 1 wherein said resonator feed presents an impedance which is a function of said location of said resonator feed relative to said first end of said dielectric substrate.

5. The omnidirectional antenna according to claim 1 wherein said resonator feed presents a short circuit to minimize static charge buildup.

6. The omnidirectional antenna according to claim 1 wherein said undesirable resonator resonance is suppressed in relation to said location of said first resonator ground relative to said first end of said dielectric substrate.

7. The omnidirectional antenna according to claim 1 wherein said radiation pattern is controlled as a function of said location of said second resonator ground relative to said first end of said dielectric substrate.

8. The omnidirectional antenna according to claim 1 wherein said ground plane provides a ground potential for a receiver coupled to said resonator feed.

9. The omnidirectional antenna according to claim 1, wherein said resonator further comprises a plurality of sockets to provide connection between said resonator and said ground plane.

10. An omnidirectional antenna for a receiving device, comprising:

a substrate having a first metallization layer for connecting components for a receiver, and at least a second metallization layer for establishing a receiver ground plane; and a resonator, comprising a dielectric substrate having a top conductive plate and a bottom conductive plate, wherein said top conductive plate is shorted to said bottom conductive plate at a first end of said dielectric substrate and open at a second end of said dielectric substrate, a resonator feed coupled to said receiver and having a location between said first and second ends of said dielectric substrate, for providing an intercepted signal to said receiver, a first resonator ground being connected to said bottom conductive plate and having a location which is distal to said first end of said dielectric substrate, and a second resonator ground being connected to said top conductive plate and to said bottom conductive plate and having a location which is proximal to said first end of said dielectric substrate, wherein said first resonator ground being connected to said ground plane for suppressing undesirable resonator resonance, and said second resonator ground being connected to said ground plane for controlling a radiation pattern of said resonator to produce a substantially omnidirectional antenna beam pattern.

11. The omnidirectional antenna according to claim 10 wherein said top conductive plate and said bottom conductive plate have a predetermined length and width, and wherein said length is substantially greater than said width.

12. The omnidirectional antenna according to claim 11 wherein said receiver has a predetermined operating frequency, and wherein said predetermined length of said top conductive plate is equal to or greater than one-quarter wavelength at the predetermined operating frequency.

13. The omnidirectional antenna according to claim 10 wherein said resonator feed presents an impedance to said receiver which is a function of said location of said resonator feed relative to said first end of said dielectric substrate.

14. The omnidirectional antenna according to claim 10 wherein said resonator feed presents a short circuit to minimize static charge buildup at said receiver.

15. The omnidirectional antenna according to claim 10 wherein said undesirable resonator resonance is suppressed in relation to said location of said first resonator ground relative to said first end of said dielectric substrate.

16. The omnidirectional antenna according to claim 10 wherein said radiation pattern is controlled as a function of said location of said second resonator ground relative to said first end of said dielectric substrate.

17. The omnidirectional antenna according to claim 10 wherein said receiver ground plane provides a ground potential for said receiver coupled to said resonator feed.

18. The omnidirectional antenna according to claim 10, wherein said resonator further comprises a plurality of sockets to provide connection between said resonator and said receiver ground plane.

19. A portable communication device comprising:

an omnidirectional antenna, comprising a substrate having a first metallization layer, and at least a second metallization layer for establishing a receiver ground plane;

a resonator, comprising a dielectric substrate having a top conductive plate and a bottom conductive plate, wherein said top conductive plate is shorted to said bottom conductive plate at a first end of said dielectric substrate and open at a second end of said dielectric substrate, a resonator feed having a location between said first and second ends of said dielectric substrate, for providing an intercepted message signal including an address, a first resonator ground being connected to said bottom conductive plate and having a location which is distal to said first end of said dielectric substrate, and a second resonator ground being connected to said top conductive plate and to said bottom conductive plate and having a location which is proximal to said first end of said dielectric substrate, wherein said first resonator ground being connected to said ground plane for suppressing undesirable resonator resonance, and said second resonator ground being connected to said ground plane for controlling a radiation pattern of said resonator to produce a substantially omnidirectional antenna beam pattern;

a receiver, interconnected by said first metallization layer and coupled to said resonator feed, for receiving and demodulating the intercepted message signal including the address by said omnidirectional antenna;

a decoder, interconnected by said first metallization layer and coupled to receiver, for decoding the address received, and for generating an alert control signal in response to the address matching a predetermined address; and alerting means, interconnected by said first metallization layer and responsive to the alert control signal, for alerting a user of a message.

20. The omnidirectional antenna according to claim 19 wherein said top conductive plate and said bottom conductive plate have a predetermined length and width, and wherein said length is substantially greater than said width.

21. The omnidirectional antenna according to claim 20 wherein said receiver has a predetermined operating frequency, and wherein said predetermined length of said top conductive plate is equal to or greater than one-quarter wavelength at the predetermined operating frequency.

22. The omnidirectional antenna according to claim 19 wherein said resonator feed presents an impedance to said receiver which is a function of said location of said resonator feed relative to said first end of said dielectric substrate.

23. The omnidirectional antenna according to claim 19 wherein said resonator feed presents a short circuit to minimize static charge buildup at said receiver.

24. The omnidirectional antenna according to claim 19 wherein said undesirable resonator resonance is suppressed in relation to said location of said first resonator ground relative to said first end of said dielectric substrate.

25. The omnidirectional antenna according to claim 19 wherein said radiation pattern is controlled as a function of said location of said second resonator ground relative to said first end of said dielectric substrate.

26. The omnidirectional antenna according to claim 19 wherein said receiver ground plane provides a ground potential for said receiver coupled to said resonator feed.

27. The omnidirectional antenna according to claim 19, wherein said resonator further comprises a plurality of sockets to provide connection between said resonator and said receiver ground plane.

28. A transmitting means comprising:

a radio wave transmitter for transmitting communication signals; and an omnidirectional antenna, coupled to said radio wave transmitter, for launching the communication signals for transmission, said omnidirectional antenna comprising a conductive plate; and a resonator, comprising a dielectric substrate having a top conductive plate and a bottom conductive plate, wherein said top conductive plate is shorted to said bottom conductive plate at a first end of said dielectric substrate and open at a second end of said dielectric substrate, a resonator feed located between said first and second ends of said dielectric substrate and coupled to said radio wave transmitter, for receiving the communication signals to be launched, a first resonator ground being connected to said bottom conductive plate and positioned distal to said first end of said dielectric substrate, and a second resonator ground being connected to said top conductive plate and to said bottom conductive plate and positioned proximal to said first end of said dielectric substrate wherein said first resonator ground being connected to said conductive plate for suppressing undesirable resonator resonance, and said second resonator ground being connected to said conductive plate for controlling a radiation pattern of said omnidirectional antenna to launch a substantially omnidirectional antenna beam.

* * * * *

UNITED STATES PATENT AND TRADEMARK OFFICE

CERTIFICATE OF CORRECTION

PATENT NO. : 5,483,246

DATED : January 9, 1996

INVENTOR(S) : Barnett, et al.

It is certified that error appears in the above-indentified patent and that said Letters Patent is hereby corrected as shown below:

Claim 1, Column 9, Line 63, change "ground plane" to --conductive plate--.

Claim 1, Column 9, Line 64, after resonator, insert --positioned adjacent to said conductive plate,--.

Claim 1, Columr 10, Line 66, after plate, insert --wherein said bottom conductive plate provides a ground plane for said resonator and --.

Claim 1, Column 10,Line 13, change "ground plane" to --conductive plate--.

Claim 1, Column 10, Line 15, change "ground plane" to --conductive plate--.

Claim 10, Column 10, Line 55, after resonator, insert --positioned adjacent to said substrate,--.

Claim 10, Column 10, Line 57, after plate, insert --wherein said bottom conductive plate provides a ground plane for said resonator and--.

Claim 10, Column 11, Line 6, after said insert --receiver--.

Claim 10, Column 11, Line 8, after said insert --receiver--.

UNITED STATES PATENT AND TRADEMARK OFFICE

CERTIFICATE OF CORRECTION

PATENT NO. : 5,483,246

DATED : January 9, 1996

INVENTOR(S) : Barnett, et al.

It is certified that error appears in the above-indentified patent and that said Letters Patent is hereby corrected as shown below:

Claim 19, Column 11, Line 47, after resonator, insert -- positioned adjacent to said substrate --.

Claim 19, Column 11, Line 49, after plate, insert -- wherein said bottom conductive plate provides a ground plane for said resonator and --.

Claim 19, Column 11, Line 66, after said insert -- receiver --.

Claim 19, Column 12, Line 1, after said insert -- receiver --.

Claim 28, Column 12, Line 57, after resonator, insert -- positioned adjacent to said conductive plate, --.

Claim 28, Column 12, Line 59, after plate, insert -- wherein said bottom conductive plate provides a ground plane for said resonator and --.

Signed and Sealed this

Twentieth Day of August, 1996

*Attest:*

Bruce Lehman

BRUCE LEHMAN

*Attesting Officer*

*Commissioner of Patents and Trademarks*